US005566660A

United States Patent [19]

Camplin et al.

[11] Patent Number: 5,566,660

[45] Date of Patent: Oct. 22, 1996

[54] FUEL INJECTION RATE SHAPING APPARATUS FOR A UNIT FUEL INJECTOR

[75] Inventors: Fred A. Camplin, Peoria; Michael A. Flinn, East Peoria; Jeffrey D. Graves, Pontiac; Lianghe Zuo, Normal, all of Ill.

[73] Assignee: Caterpillar Inc., Peoria, Ill.

[21] Appl. No.: 420,930

[22] Filed: Apr. 13, 1995

[51] Int. Cl.[6] ..... F02M 37/04; F02M 47/02; F02B 3/00

[52] U.S. Cl. ..... 123/496; 123/299; 123/500; 239/88

[58] Field of Search ..... 123/506, 500, 123/501, 299, 300, 496; 417/494, 499; 92/51; 239/88, 90–91, 93, 95

[56] References Cited

U.S. PATENT DOCUMENTS

| | | | |
|---|---|---|---|
| 2,147,390 | 2/1939 | Vaudet | 123/500 |
| 2,282,562 | 5/1942 | Cole | 417/499 |
| 2,892,687 | 5/1957 | Snell | 60/54.6 |
| 3,209,737 | 10/1965 | Omotehara et al. | 123/90 |
| 3,269,275 | 8/1966 | Waite | 92/52 |
| 3,269,462 | 8/1966 | Voetter | 166/100 |
| 3,689,205 | 9/1972 | Links | 417/401 |
| 4,054,248 | 10/1977 | Beardmore | 239/88 |
| 4,146,178 | 3/1979 | Bailey | 123/506 |
| 4,281,792 | 8/1981 | Sisson et al. | 239/5 |
| 4,327,694 | 5/1982 | Henson et al. | 123/500 |
| 4,392,612 | 7/1983 | Deckard et al. | 239/88 |
| 4,437,443 | 3/1984 | Hofbauer | 123/446 |
| 4,572,738 | 7/1985 | Martin | 239/90 |
| 4,611,566 | 9/1986 | Kampichler et al. | 123/506 |
| 4,630,587 | 12/1986 | Hofer et al. | 239/93 |
| 4,811,899 | 3/1989 | Egler | 239/5 |
| 4,907,559 | 3/1990 | Rathmayr | 123/500 |
| 5,033,442 | 7/1991 | Perr et al. | 123/502 |
| 5,094,397 | 3/1992 | Peters et al. | 239/88 |
| 5,121,730 | 6/1992 | Ausman et al. | 123/467 |
| 5,143,291 | 9/1992 | Grinsteiner | 239/88 |
| 5,271,371 | 12/1993 | Meints et al. | 123/446 |

FOREIGN PATENT DOCUMENTS

| | | | |
|---|---|---|---|
| 402886 | 12/1933 | United Kingdom | 123/501 |
| 1043383 | 9/1966 | United Kingdom . | |
| 2094901 | 9/1982 | United Kingdom | 123/500 |
| 2213873 | 8/1989 | United Kingdom . | |

*Primary Examiner*—Thomas N. Moulis
*Attorney, Agent, or Firm*—Mark D. Becker

[57] ABSTRACT

A multipiece fuel pump plunger assembly for controlling the fuel injection rate and delivery during the initial injection portion of a fuel injection cycle for an internal combustion engine. The injector includes a two piece plunger assembly including a plunger and a plunger sleeve. The plunger having a small predetermined diameter and being slidably positioned within a plunger sleeve having a diameter greater than the diameter of the plunger. The multipiece plunger is advantageous because it allows for shaping of the rate of fuel injected into the combustion process thereby reducing the excess fuel flow in the early portion of the injection cycle. Elimination of the excess fuel flow results in lower oxides of nitrogen and particulate exhaust emission levels and less engine noise.

13 Claims, 2 Drawing Sheets

FUEL INJECTION RATE SHAPING APPARATUS FOR A UNIT FUEL INJECTOR

TECHNICAL FIELD

The present invention relates to fluid unit injectors and more particularly to fuel injection rate shaping for fuel unit injectors.

BACKGROUND ART

Engine exhaust emission regulations are becoming increasingly restrictive. One way in which the stricter emission standards can be met is to tailor the rate, or rate-shape the quantity and timing of the fuel injected into the combustion chamber to match the engine cycle. The ability to match the desired fuel/air ratio can result in reduced levels of particulate and oxides of nitrogen in the engine exhaust.

A second problem which rate-shaping improves is engine noise. By injecting the fuel slower during the early phase of the combustion process, combustion is less harsh which results in less engine noise. The present invention is directed to overcome one or more of the problems as set forth above.

DISCLOSURE OF THE INVENTION

In one aspect of the present invention, a fluid unit injector rate shaping apparatus is disclosed. The apparatus includes a housing having a longitudinal bore and a plunger sleeve having a longitudinal extending bore. The plunger sleeve is movable within and relative to the housing bore. The housing, the housing bore and the plunger sleeve define a fluid pump chamber. The plunger sleeve is movable a preselected distance into the pump chamber. A plunger is slidably positioned in the plunger sleeve bore and is movable a preselected distance into the pump chamber. The apparatus includes a first means of moving the plunger in a direction toward the fluid pump chamber and a second means of moving the plunger sleeve in a direction toward the fluid pump chamber during movement of the plunger.

In another aspect of the present invention a fluid unit injector is disclosed. The injector includes a fluid pump cylinder. The pump cylinder has a discharge outlet associated with one end, a fluid receiving chamber externally of the cylinder, and a fluid port spaced from the outlet and interconnecting the interior of the cylinder with the receiving chamber. A plunger is longitudinally reciprocable within the pump cylinder. The plunger and the cylinder define a pumping chamber. The improvement comprises a means positioned within the fuel pump cylinder and which is actuatable by movement of the plunger for shaping the rate at which force is exerted on liquid in the pumping chamber.

In another aspect of the present invention a mechanically-actuated fluid unit injector is disclosed. The injector includes a fluid pump cylinder having a discharge outlet associated with one end, a fluid receiving chamber externally of the cylinder, a fluid port spaced from the outlet and interconnecting the interior of the cylinder with the receiving chamber, a plunger longitudinally reciprocable within the pump cylinder, the plunger and cylinder defining a pumping chamber. The improvement comprising a plunger sleeve movable in said pump cylinder and actuatable by movement of the plunger. The plunger sleeve includes a longitudinal bore. The plunger is reciprocable in the bore. The plunger sleeve has an upper and a lower port connecting the bore to the receiving chamber. The plunger further includes an internal passage connecting the pumping chamber to the bore. The passage is positioned such that during movement of the plunger in its pumping direction, the plunger blocks the plunger sleeve lower port to initiate a pre-injection. The plunger passage communicates with the lower port to terminate pre-injection. The plunger sleeve ports are further positioned such that during the movement of the plunger sleeve in its pumping direction, the lower port is closed to initiate main injection and the upper port is opened to terminated main injection.

BEST MODE FOR CARRYING OUT THE INVENTION

Figure 1:
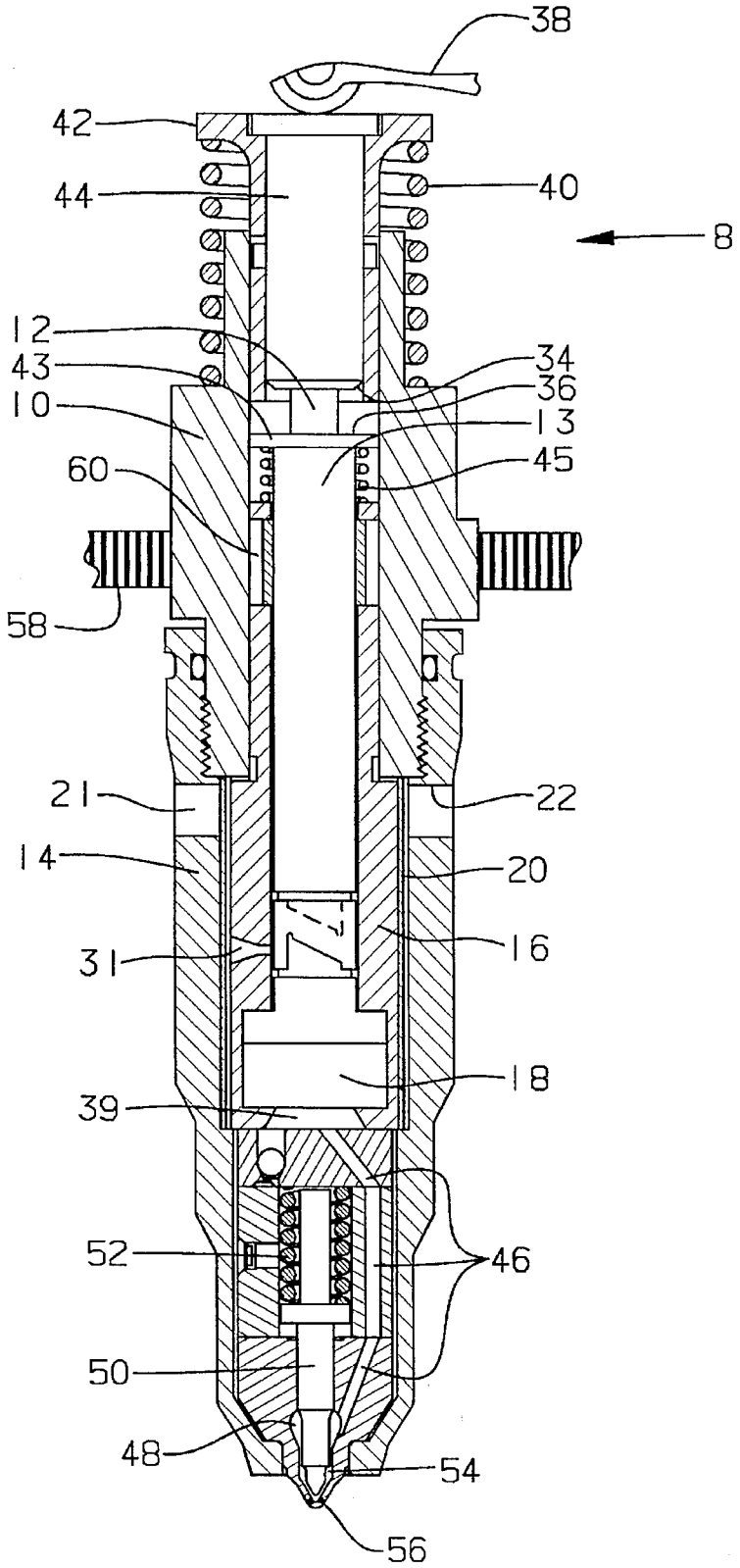
FIG. 1 is a longitudinal section of a mechanically-actuated unit injector for an internal combustion engine made according to one embodiment of the present invention.

Referring to FIG. 1 of the drawings, a mechanical unit injector 8 is shown, the upper portion of which is conventional and comprises a housing 10 in which a plunger 12 and plunger sleeve 13 are reciprocable. Forming an extension of and threaded to the lower end of the housing 10 is a lower extension 14, within which is supported a bushing 16 forming a pump cylinder 18 for the plunger 12 and plunger sleeve 13. An annular space 20 surrounds the bushing 16 within the lower extension 14 and is supplied with fuel via a fuel passage 21 which is connected to a fuel pump (not shown). Any excess fuel supplied to the annular space 20 flows through an outlet 22 and is returned to the fuel tank (not shown).

Figure 3A:
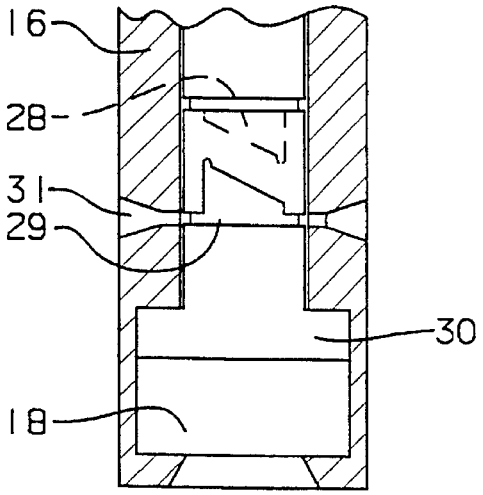
FIGS. 3*a* and 3*b* are diagrammatic enlarged partial views of the lower end portion of the plunger sleeve and plunger of the unit injector shown in FIG. 1.
Figure 3B:
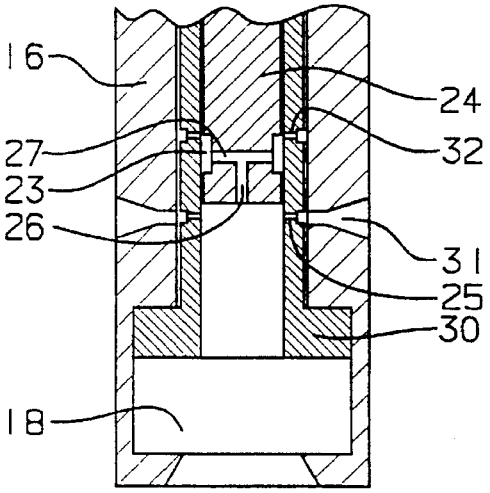

As shown in FIG. 3*b*, the plunger 12 is 10 slidably positioned within the plunger sleeve 13. The plunger 12 has an external groove 23 adjacent its lower end portion 24, by which opening and closing of lower fuel port 25 in the plunger sleeve 13 are controlled. The plunger 12 also includes connecting axial and transverse passages, 26 and 27 respectively, for bypassing fuel from the pump cylinder 18 to the annular space 20 when the groove 23 is in fluid communication with the lower ports 25 in the plunger sleeve 13.

As shown in FIGS. 3*a* and 3*b*, the plunger sleeve 13 has two external grooves adjacent the plunger sleeve lower end portion 30. The plunger sleeve 13 upper external scroll groove 28, and lower external scroll groove 29, control the opening and closing of ports 31 in the bushing 16. The plunger sleeve 13 includes connecting lower transverse fuel ports 25 for bypassing fuel from the pump cylinder 18 via the plunger passages 26 and 27 to the annular space 20 when the lower external groove 29 is in fluid communication with the ports 31. The plunger sleeve 13 also includes connecting upper transverse fuel ports 32 for bypassing fuel from the pump cylinder 18 via the plunger passages 26 and 27 to the annular space 20 when the upper scroll groove 28 is in fluid communication with the ports 31. The plunger sleeve lower end portion 30 has a preselected diameter of a magnitude greater than the preselected diameter of the plunger lower end portion 24.

During each downward or pumping stroke of the plunger 12 from its illustrated position in FIGS. 1 and 3*b* (effected by means of an engine rocker 38), fuel is initially bypassed to the fuel space 20 from the cylinder 18 below the plunger 12 and plunger sleeve 13 via passages 25 and 31. After the plunger lower end portion 24 blocks fluid communication with passage 25, fuel is displaced under pressure through the lower open end 39 of the cylinder 18 to initiate a pre-injection of fuel through the spray orifices 56. This continues until groove 23 moves into fluid communication with passages 25 and 31 to again bypass fuel and end pre-injection.

As the plunger 12 continues its downward movement, the lower end of the plunger follower 42 contacts the plunger sleeve upper end 36. Through the remaining portion of the downward or pumping stroke, the plunger 12 and the plunger sleeve 13 move together as one. Fuel continues to be bypasses to the fuel space 20 from the cylinder 18, but after the plunger sleeve lower groove 29 moves out of fluid communication with the port 31, fuel is displaced under high pressure through the lower open end 39 of the cylinder 18 by movement of the plunger 12 and plunger sleeve 13. Main injection continues until the upper scroll groove 28 moves into fluid communication with the port 31 to again bypass fuel via passages 26 and 27 in the plunger 12 and passage 32 in the plunger sleeve 13. Upon the plunger 12 and plunger sleeve 13 thereafter reaching their lower most position and during retraction of the rocker arm 38, return of the plunger 12 is effected by a spring 40, which, as shown in FIG. 1, may be interposed for this purpose between the housing 10 and a follower 42 attached to the upper end portion 44 of the plunger 12. Return of the plunger sleeve 13 is effected by a plunger sleeve spring 45, which as shown, is interposed between the bushing 16 and the plunger sleeve shoulder 43.

As shown in FIG. 1, the fuel charge delivered from the pump cylinder 18 flows through a passage 46 into the lower end or spray tip 48 of the injector where it acts upwardly against the injection valve 50 to raise the latter against its biasing spring 52 to open fuel outlet 54 for injection of the fuel charge into the engine combustion chamber (not shown) via spray orifices 56. Other details of the injector below the lower end 39 of the pump bushing are conventional and form no part of the present invention.

Also, the plunger sleeve 13 is angularly rotatable by means of a rack 58 and pinion 60, in accordance with conventional practice, thereby enabling regulation of the fuel charge injected per cycle. By rotating the plunger sleeve 13, the relationship between the upper and lower plunger sleeve grooves 28 and 29 and the fuel ports 31 may be varied, thereby varying the point at which the pumping stroke begins and ends, consequently varying the quantity of fuel injected and the timing of the main injection stroke.

The plunger 12 is not angularly rotatable by means of the rack 58 and pinion 60. Therefore, the quantity of pre-injection fuel supplied will be constant and controlled by the axial distance between the plunger lower end portion 24 and the plunger groove 23. It is important to note that the quantity of fuel injected during this pre-injection period is insufficient to sustain engine operation.

Figure 2:
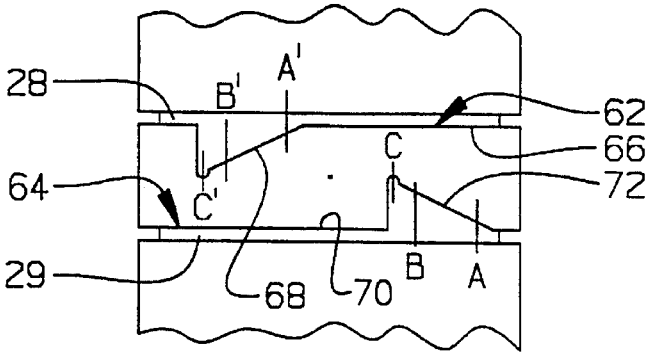
FIG. 2 is an enlarged developed view of the injector plunger sleeve in the vicinity of its two scroll grooves of the unit injector shown in FIG. 1.

Main fuel injection is controlled continually over the entire spectrum of engine operating conditions by means of the upper plunger sleeve scroll groove 28 and the lower plunger sleeve scroll groove 29 which are disposed helically of the plunger sleeve axis. Upper control edge 62 is formed around the periphery of the plunger sleeve 13 in the upper plunger sleeve scroll groove 28. Lower control edge 64 is formed around the periphery of the plunger sleeve 13 in the lower plunger sleeve scroll groove 29. Referring to FIG. 2, which is a developed view of the entire circumferential plunger sleeve grooves 28 and 29, it will be seen that the upper control edge 62 includes a flat portion, 66 perpendicular to the longitudinal axis of the plunger sleeve 13 and an inclined portion 68. Likewise, the lower control edge 64 is comprised of a flat section 70 and an inclined portion 72. It is important to note that the upper inclined edge 68 is formed at an angle opposite to that of the lower inclined edge 72. Also, since the fuel ports 31 are diametrically opposed, the portion of the upper inclined portion 68 in communication with the one fuel port 31 will correspond to a point of fluid communication between the lower inclined portion 72 and the corresponding fuel port 31 that is 180° out-of-phase.

The upper and lower control edges 62 and 64 respectively, perform the dual functions of controlling the amount of fuel injected and controlling injection timing, which refers to the portion of the engine cycle at which fuel injection begins.

The quantity of fuel injected is determined by the axial spacing between the control edges 62 and 64. Main fuel delivery begins when the lower control edge 64 moves out of fluid communication with the fuel port 31, and ends when the upper control edge 62 moves into fluid communication with the fuel port 31. The amount of fuel injected is thus directly proportional to the distance between the lower control edge 64 and the upper control edge 62. This is so because if the gap is relatively small, the distance the plunger sleeve 13 will travel after the lower control edge 64 moves out of registry with the fuel port 31 and before the upper control edge 62 comes into registry will be relatively short thereby injecting a small quantity of fuel. The converse is true; if the gap between the lower 64 and upper 62 control edges is relatively large, the plunger sleeve 13 will travel a long distance after the lower plunger sleeve groove 29 moves out of registry with the fuel port 31 and before the upper plunger sleeve groove 28 moves into registry with the port 31, thereby injecting a relatively large amount of fuel.

Due to the inclined portion 72 of the lower control edge 64, the gap distance between corresponding points on the lower and upper edges 64 and 62 may be continuously varied by rotation of the plunger sleeve 13. As shown in FIG. 2, as the plunger is rotated from a position where point A on the lower edge 64 is aligned with fuel port 31 to a position wherein point B is aligned with the fuel port 31, the distance between the lower control edge 64 and the upper control edge 62 will be continually decreased. Therefore, the quantity of fuel injected during each plunger stroke will be correspondingly continually decreased.

Injection timing, on the other hand, is controlled within the injector by the axial position of the lower control edge 64 with respect to the fuel port 31. Main fuel injection begins only when the lower scroll groove 29 moves out of fluid communication with the fuel port 31. This is because fuel will continue to be bypassed through the axial and transverse passageways 25, 26, and 27 and groove 29 and the fuel port 31 until the lower control edge 64 completely passes out of fluid communication with the port 31. Thus if the lower control edge were translated upward along the plunger sleeve 13, as viewed in FIG. 3*a*, fuel injection would occur later in the engine cycle since the plunger sleeve must travel a greater distance before the lower control edge 64 passes the port 31. The consequence of the inclined portion 72 of the lower control edge 64 is that as the plunger sleeve 13 is rotated from a position where point A is aligned with the port 31 to a position where point B on the inclined surface 72 is aligned with the port 31, main fuel injection timing will be progressively retarded, i.e. main fuel injection will occur progressively later in the engine operating cycle.

Since the shape of the lower control edge 64 is at least partially responsible for injection timing and the coaction of control edges 64 and 62 control the quantity of fuel injected, the result is that both injection timing and the quantity of fuel injected during each main injection stroke may be simultaneously varied by rotation of the plunger sleeve 13.

Referring to FIG. 2, as the plunger sleeve 13 is rotated from a position where points A and A' are aligned with the fuel ports 31 to a position where points B and B' are aligned with these ports, main fuel injection will be continuously varied between conditions wherein a large amount of fuel is injected relatively early in the engine cycle (A—A') to a condition where a small amount of fuel is injected relatively late in the engine cycle (B—B').

The flat portions 66 and 70 of the upper 62 and lower 64 control edges are at no time aligned with either of the fuel ports 31 and therefore form no part of the fuel injection process. These surfaces are present merely to complete the circumferential grooves 28 and 29 around the plunger sleeve 13.

The notches indicated by C and C' in FIG. 2, are included in the grooves 28 and 29 to provide a means to shutoff the engine. When the plunger is rotated such that C and C' are aligned with the fuel ports, 31 it will be seen that no fuel will be injected during main injection and thus the engine will be fuel starved and will cease operation.

INDUSTRIAL APPLICABILITY

Unit injectors known in the art utilize a single plunger to compress the fuel in the pumping chamber prior to injection into the combustion chamber of an internal combustion engine. An example of a mechanical unit fuel injector is shown in U.S. Pat. No. 4,327,694 issued to Henson et al. on May 4, 1982. Examples of hydraulically-actuated electronically controlled unit injectors are shown in U.S. Pat. No. 3,689,205 issued to Links on Sep. 5, 1972 and U.S. Pat. No. 5,271,371 issued to Meints et al. on Dec. 21, 1993. In each of these patents, a single plunger is used to pressurize the fuel in the pumping chamber prior to injection. This technique results in a fuel flow rate early in the combustion cycle higher than that required to maintain combustion. For small engines, this is particularly noticeable at idle or low power engine operation and can result in harsh combustion and high exhaust emissions.

The present invention reduces fuel flow in the pre-ignition portion of the engine cycle by shaping the rate of fuel injection early in the combustion cycle. The improvement to the unit injectors described above allows for rate-shaping by control of multiple plungers within the injector through the movement of the engine rocker arm.

Other aspects, objects and advantages of this invention can be obtained from a study of the drawings, the disclosure and the appended claims.

What we claimed is:

1. A fluid unit injector rate shaping apparatus, comprising:

a housing having a longitudinal bore;

a plunger sleeve having a longitudinal extending bore and being movable within and relative to said housing bore, said housing, said housing bore and said plunger sleeve defining a fluid pump chamber, said plunger sleeve being movable a preselected distance into the pump chamber;

a plunger slidably positioned in said plunger sleeve bore and being movable a preselected distance into the pump chamber;

first means of moving said plunger in a direction toward the fluid pump chamber;

second means of moving said plunger sleeve in a direction toward the fluid pump chamber during movement of said plunger.

2. An apparatus as set forth in claim 1, wherein said plunger includes a upper end portion, said first means including an engine rocker arm exerting pressure on said plunger upper end portion.

3. An apparatus as set forth in claim 1, wherein said second means includes a plunger sleeve upper end and a plunger shoulder portion, said plunger shoulder portion contacting said plunger sleeve upper end in response to the plunger moving a preselected distance into the pumping chamber.

4. A fluid unit injector having a fluid pump cylinder, said pump cylinder including a discharge outlet associated with one end, a fluid receiving chamber external of the cylinder, a fluid port spaced from said outlet and interconnecting the interior of the cylinder with said receiving chamber, a plunger longitudinally reciprocable within said pump cylinder, said plunger and said cylinder defining a pumping chamber, the improvement comprising:

means positioned within said fuel pump cylinder and being actuatable by movement of the plunger for shaping the rate at which force is exerted on liquid in the pumping chamber.

5. A fluid unit injector, according to claim 4, wherein said means includes a plunger moveable a first preselected distance in a direction into the pumping chamber to initiate a pre-injection, and;

a plunger sleeve moveable into the pumping chamber in response to the plunger moving a second preselected distance toward the liquid chamber to initiate a main injection.

6. An apparatus, as set forth in claim 5, wherein said plunger and plunger sleeve each have a first end portion, said plunger sleeve first end portion having a preselected diameter of a magnitude greater than the preselected diameter of the plunger first end portion.

7. A mechanically-actuated fluid unit injector, said injector having a fluid pump cylinder having a discharge outlet associated with one end, a fluid receiving chamber externally of the cylinder, a fluid port spaced from said outlet and interconnecting the interior of the cylinder with said receiving chamber, a plunger longitudinally reciprocable within said pump cylinder, said plunger and said cylinder defining a pumping chamber, the improvement comprising:

a plunger sleeve being movable in said pump cylinder and actuatable by movement of the plunger, said plunger sleeve including a longitudinal bore, said plunger being reciprocable in said bore, said plunger sleeve having an upper and a lower port connecting said bore to said receiving chamber, and;

said plunger further including an internal passage connecting said pumping chamber to said bore, the passage being positioned such that during movement of the plunger in its pumping direction, said plunger blocks the plunger sleeve lower port to initiate a pre-injection and said plunger passage communicates with said lower port to terminate pre-injection, said plunger sleeve ports further being positioned such that during the movement of the plunger sleeve in its pumping direction, said lower port is closed to initiate main injection and said upper port is opened to terminated main injection.

8. A mechanically-actuated fluid unit injector, according to claim 7, wherein the lower and the upper plunger sleeve ports are axially spaced apart from one another to control the quantity of fluid injected during said main injection.

9. A mechanically-actuated fluid unit injector, according to claim 7, wherein the plunger sleeve is axially rotatable and the lower and upper plunger sleeve ports are positioned within a lower and an upper scroll groove disposed helically of the plunger sleeve axis on the outer periphery of said plunger sleeve, said grooves being positioned such that the quantity of fluid injected during said main injection may be continually varied by rotational adjustment of said plunger sleeve.

10. A mechanically-actuated fluid unit injector, according to claim 7, wherein the plunger sleeve is axially rotatable and the lower and upper plunger sleeve ports are positioned within a lower and an upper scroll groove disposed helically of the plunger sleeve axis on the outer periphery of said plunger sleeve, said grooves positioned such that the initiation and termination of said main injection may be continually varied by rotational adjustment of said plunger sleeve.

11. A mechanically-actuated fluid unit injector according to claim 7, wherein the plunger further includes a plunger shoulder and the plunger sleeve includes an upper end portion, said plunger sleeve actuatable by movement of said plunger a preselected distance engaging said plunger shoulder with said plunger sleeve upper end portion.

12. A mechanically-actuated fluid unit injector according to claim 11, further including a plunger spring interposed between said plunger sleeve upper end portion and said pump cylinder whereby the plunger sleeve is retracted in a direction away from said pumping chamber.

13. A mechanically-actuated fluid unit injector according to claim 12, further including a spring interposed between said plunger and said housing whereby the plunger is retracted in a direction away from said pumping chamber.

* * * * *